US005283612A

United States Patent [19]

Lödermann et al.

[11] Patent Number: 5,283,612

[45] Date of Patent: Feb. 1, 1994

[54] ARRANGEMENT FOR THE MECHANICAL COUPLING OF PHYSICAL UNITS OF AN ELECTROPHOTOGRAPHIC PRINTER OR COPIER

[75] Inventors: Gerhard Lödermann, Munich; Josef Windele, Puchheim, both of Fed. Rep. of Germany

[73] Assignee: Siemens Nixdorf Informationssysteme Aktiengesellschaft, Fed. Rep. of Germany

[21] Appl. No.: 859,488

[22] PCT Filed: Dec. 3, 1990

[86] PCT No.: PCT/EP90/02075

§ 371 Date: Jun. 15, 1992

§ 102(e) Date: Jun. 15, 1992

[87] PCT Pub. No.: WO91/09349

PCT Pub. Date: Jun. 27, 1991

[30] Foreign Application Priority Data

Dec. 13, 1989 [EP] European Pat. Off. ..... 89123034.4

[51] Int. Cl.[5] ..... G03G 15/00

[52] U.S. Cl. ..... 355/200; 355/322

[58] Field of Search ..... 355/200, 308, 321, 322, 355/133

[56] References Cited

U.S. PATENT DOCUMENTS

| | | | |
|---|---|---|---|
| 4,185,760 | 1/1980 | McNew | 226/109 |
| 4,270,911 | 6/1981 | McNew | 493/410 |
| 4,478,508 | 10/1984 | Kato et al. | 271/152 |
| 4,563,078 | 1/1986 | Fantuzzo et al. . | |
| 4,843,429 | 6/1989 | Avritt et al. | 355/274 |
| 5,029,743 | 7/1991 | McNew | 226/199 |

FOREIGN PATENT DOCUMENTS

| | | |
|---|---|---|
| 0174113 | 3/1986 | European Pat. Off. . |
| 2110651 | 6/1983 | United Kingdom . |

*Primary Examiner*—R. L. Moses

*Attorney, Agent, or Firm*—Hill, Steadman & Simpson

[57] ABSTRACT

An arrangement for the mechanical coupling of physical units, such as, for example, of a printing assembly (15) of an electrophotographic printer or copier, to further physical units (23, 24) in axially parallel orientation with respect to the transport path of a recording carrier (12) includes a basic unit (28) containing especially the printing assembly (15) coupled in an articulated manner to a carrier (32), oriented vertically with respect to a machine frame (1), via a crossmember (30) which consists especially of two individual crossmember elements (301, 302). The physical units (23 or 24) to be arranged axially parallel with respect to the basic unit are then themselves articulated on the carrier (32) in paired receptacles (for example C1, C2).

16 Claims, 2 Drawing Sheets

ARRANGEMENT FOR THE MECHANICAL COUPLING OF PHYSICAL UNITS OF AN ELECTROPHOTOGRAPHIC PRINTER OR COPIER

BACKGROUND OF THE INVENTION

1. Field of the Invention

The invention relates to an arrangement for the mechanical coupling of physical units, such as, for example, of a printing assembly of an electrophotographic printer or of a copier, to further physical units in axially parallel orientation with respect to the transport path of a recording carrier running through.

2. Description of the Related Art

Printers or copiers working on the electrophotographic principle are generally known. The electrophotographic printing principle as such involves a relatively high outlay. As an intermediate carrier for printing information generally there is provided a continuously rotating photoconductive drum which is initially charged uniformly when rotating in order to generate a latent charge image. The uniform charge is discharged light-optically point-by-point as a function of the printing information and consequently produces on the intermediate carrier a charge distribution corresponding to the printing information. This charge image is inked by means of a toner mixture by the utilization of electrostatic forces, and subsequently the toner particles are transferred onto a recording carrier and fixed there chemically or thermally.

Especially critical junctures in this process are the transfer of the toner particles onto the recording carrier, the so-called transfer printing, the further transport of the recording carrier together with the transfer-printed toner image which is not yet smudge-proof, and the fixing operation. Particularly in this region of the transport path of the recording carrier through the printer or copier, the quality of the printing result is influenced decisively. Thus, for example, it is of paramount importance that, in the transfer-printing station, the recording carrier be moved exactly axially parallel to and without relative speed in respect of the intermediate carrier, that is to say the photoconductive drum, otherwise the printing image is smudged even as early as here. The fixing operation is similarly critical, especially when the fixing of the toner image on the recording carrier is executed by means of the thermal printing process. In this process, the recording carrier runs between a pair of rollers, the so-called fixing roller and the pressure roller. The heated fixing roller, which faces toward the image side of the recording carrier, transmits a sufficient quantity of heat to the recording carrier in order, in combination with the pressure exerted by the pressure roller, to plasticize the toner particles and fuse them on the surface of the recording carrier. Here too, it is of absolutely essential importance that said pair of rollers at the fixing station be set exactly axially parallel to the transport path of the recording carrier, otherwise there are not only mechanical pinchings of the conveyed recording carrier, but also defects in the fixing which lead to a reduction of the printing quality.

It must be remembered, at the same time, that current electrophotographic printers generating the printing information in the form of dots by the screen process already produce in the high-performance range a screen of the order of magnitude of 600 dpi (dots per inch) and more. Screen-dot widths of the order of magnitude of 0.04 mm and below correspond to this. These figures highlight the mechanical and structural requirements demanded as regards the accuracy of transport of the recording carrier with respect to the individual assemblies of the electrophotographic printer or copier, if the aim is to obtain a printing result having the contrast definition which can be achieved per se by means of the printing process.

Known furthermore is the basic mechanical construction of such printers or copies which work on the electrophotographic principle. In addition to the exact allocation of individual assemblies of the printer or copier to the transport path of the recording carrier obtained by means of drive and guide elements, it is necessary, moreover, to bear in mind that individual assemblies should be relatively easily accessible, for example for maintenance work. Finally, at least some of these assemblies should also be pivotable away from the transport path of the recording carrier. This is especially true when the recording carrier is fashioned as continuous stock and, before the start of a printing operation, the start of a paper web first has to be inserted into the printer or copier.

The mechanism of electrophotographic printers or copiers is correspondingly complicated and involves a high outlay. For simpler mounting, but also for maintenance reasons, therefore, electrophotographic printers or copiers are constructed in a modular manner from individual physical units, appropriate tolerance limits being adhered to within a module, so that this module can then also be exchanged in a relatively simple way, apart from a secondary condition, namely that, after such an exchange, the necessary axially parallel orientation with respect to the corresponding part of the transport path of the recording carrier has to be provided once again. The first mounting in the assembling of the individual physical units to form a printer or copier therefore conventionally necessitates a series of time-consuming measures involving a high mechanical outlay, precisely also in order to orient all the individual physical units exactly axially parallel to one another. The same applies accordingly when test or maintenance work has to be carried out.

SUMMARY OF THE INVENTION

Starting from the consideration that it must be possible, within individual integrated physical units, to arrange the elements of these units relative to one another in such a way that, especially where wear parts are concerned, they can be positioned relative to specific fixed points in the individual module without any special outlay, the object on which the present invention is based is to develop an arrangement of the type mentioned in the preamble, in such a way that by simple means, during a first mounting, but also during an exchange of individual physical units, an axially parallel orientation of the individual physical units relative to one another can be obtained directly, without mensurationally complicated and time-consuming adjustment operations being necessary for this.

In an arrangement of the kind cited initially, this object is achieved, according to the invention, by an electrophotographic printer or copier having a machine frame, a basic unit which has a printing assembly and is arranged with its major axis in a plane parallel to the transport path of a recording carrier, perpendicularly to the direction of transport of the latter, and further physical units which are coupled mechanically to the basic unit and the major axes of which are oriented parallel to one another and to the major axis of the basic unit, in that there are provided a carrier, arranged on the machine frame, and a crossmember which is respectively connected rotationally movably to the basic unit and to the carrier, at two receiving points located in the direction of these major axes and remote from one another, in planes perpendicular to these major axes, in that adjustment means are provided for orienting the carrier vertically with the machine frame, and in that the further physical units are respectively articulated on the carrier in paired receptacles, the connecting lines of which are themselves oriented parallel to the major axes.

The solution according to the invention basically starts from the fact that the electrophotographic process already prescribes a printing unit as the core of such a printer or copier, the intermediate carrier, i.e. the photoconductive drum, being arranged in the center thereof. As initially indicated, there is already arranged around the photoconductive drum a multiplicity of individual components which have to be oriented exactly with this so that a faultless charge image inked corresponding to the printing information can be generated. It is therefore appropriate to design this essential item of an electrophotographic printer or copier as a physical unit. It can be expedient, furthermore, to construct this printing assembly, together with the devices guiding the recording carrier to this printing assembly and away from it again, as an integrated basic unit. It can be designed as a unit in such a way that this guiding of the recording carrier to and away from the printing assembly takes place exactly, that is to say, in particular, the paper-guide elements also allow a perfect axially parallel transport of the recording carrier with respect to the photoconductive drum. However, the remaining physical units of the printer or copier now have to be coupled exactly axially parallel to such a or to a similar basic unit.

For this, according to the invention, a carrier is provided for these physical units not integrated in the basic unit, which carrier possesses corresponding receptacles for the physical units to be added, so that these physical units are already oriented exactly with the carrier simply by being suspended. There is then the problem of first orienting this carrier itself axially parallel to said basic unit. This is achieved here by means of a crossmember which is connected, on the one hand, to the basic unit at two articulation points and, on the other hand, to the carrier at two further articulation points. When the basic unit is fastened to a skeleton or frame of the printer or copier, then after the coupling of the carrier to the basic unit by means of the crossmember it is merely necessary to orient said carrier with respect to the skeleton in one direction, especially the vertical direction, the axial parallelism of the carrier relative to the basic unit being necessarily obtained, and consequently also the physical units to be fastened to the carrier themselves each being oriented axially parallel with the basic unit without further adjustment measures.

It then also follows from this that, insofar as the suspension points of the physical units on the carrier have sufficiently narrow tolerances, the individual physical units fastened to the carrier are independently exchangeable. As an example, this also applies especially to the fixing station of the printer or copier, which station is designed as an independent physical unit. It was stated at the outset that its axial parallelism with the printing assembly is particularly critical. In addition, if the thermal printing process is employed for fixing, the fixing station also undergoes thermal expansions during operation and therefore corresponding degrees of freedom for thermal expansion have to be provided, without the axially parallelism being lost. According to a development of the invention, this can be achieved in that the fixing station is suspended only in side parts of the carrier, is fastened axially relative to this carrier at a bearing point and rests on it at a further seating point fixed relative to the housing. The fixing station is therefore articulated, for operation, specifically both axially and vertically with two degrees of freedom in respect of the rigid carrier, but nevertheless is directly exchangeable as an individual physical unit.

Other developments of the invention include the crossmember comprising two crossmember elements uncoupled from one another, and the carrier of U-shaped basic form having two side parts which stand vertically in the installed state and which are connected rigidly to one another via a base part resting on the machine frame and oriented parallel to the major axes, and the crossmember elements being articulated rotatably each independently on the basic unit and one one of the side parts. The electrophotographic printer or copier is further defined as the base part of the carrier having three seating points, at which it is vertically orientable with respect to the machine frame in the state already articulated on the basic unit via the crossmember.

The preferred embodiment has the side parts of the carrier each having an arm projecting laterally transversely to the major axes and having a bearing lug, on which one end of each of the crossmember elements is respectively articulated rotatably via a connecting element, the other ends of the crossmember elements being respectively articulated on one of two bearing lugs of the basic unit via a further connecting element.

The fixing station of the printer or copier machine and/or a paper-stacking device each form one of the physical units to be coupled to the basic unit. The physical unit to be coupled, especially the fixing station, is respectively suspended rotationally movably at one of two receiving points arranged mirror-symmetrically to one another in the side parts of the carrier, and on the housing frame or on the carrier there is provided a seating point at which this physical unit is supported vertically.

A bearing face is provided on the carrier, for the physical unit to be coupled, as a reference line for the orientation of the physical unit parallel to the major-axes direction.

The side parts of the carrier each have a running profile, and a physical unit to be coupled, especially a lowerable delivery table for a stack of recording carriers, possesses laterally arranged running rollers which are inserted into the running profiles, at least one of the running rollers being at a predetermined vertical distance from the others, and in that vertical supporting means are provided for the physical unit to be coupled. Furthermore, the physical unit to be coupled is arranged vertically displaceably in the side parts of the carrier, the supporting means being designed as raising and lowering means which allow a vertical movement of the running rollers in the running profiles. The raising and lowering means consist respectively of a motor-driven pinion, mounted rotationally movably in the side parts of the carrier above the displaceably arranged physical unit, and of a chain which is in engagement with the pinion and the ends of which are fastened fixedly in place or are articulated on the physical unit. The receptacles for the pinion coupled to a drive unit, for the chain and/or for running rails which form the running profiles, are provided in the side parts of the carrier.

BRIEF DESCRIPTION OF THE DRAWINGS

An exemplary embodiment of the invention is explained in more detail below by means of a drawing, in which.

DETAILED DESCRIPTION OF THE PREFERRED EMBODIMENTS

Figure 1:
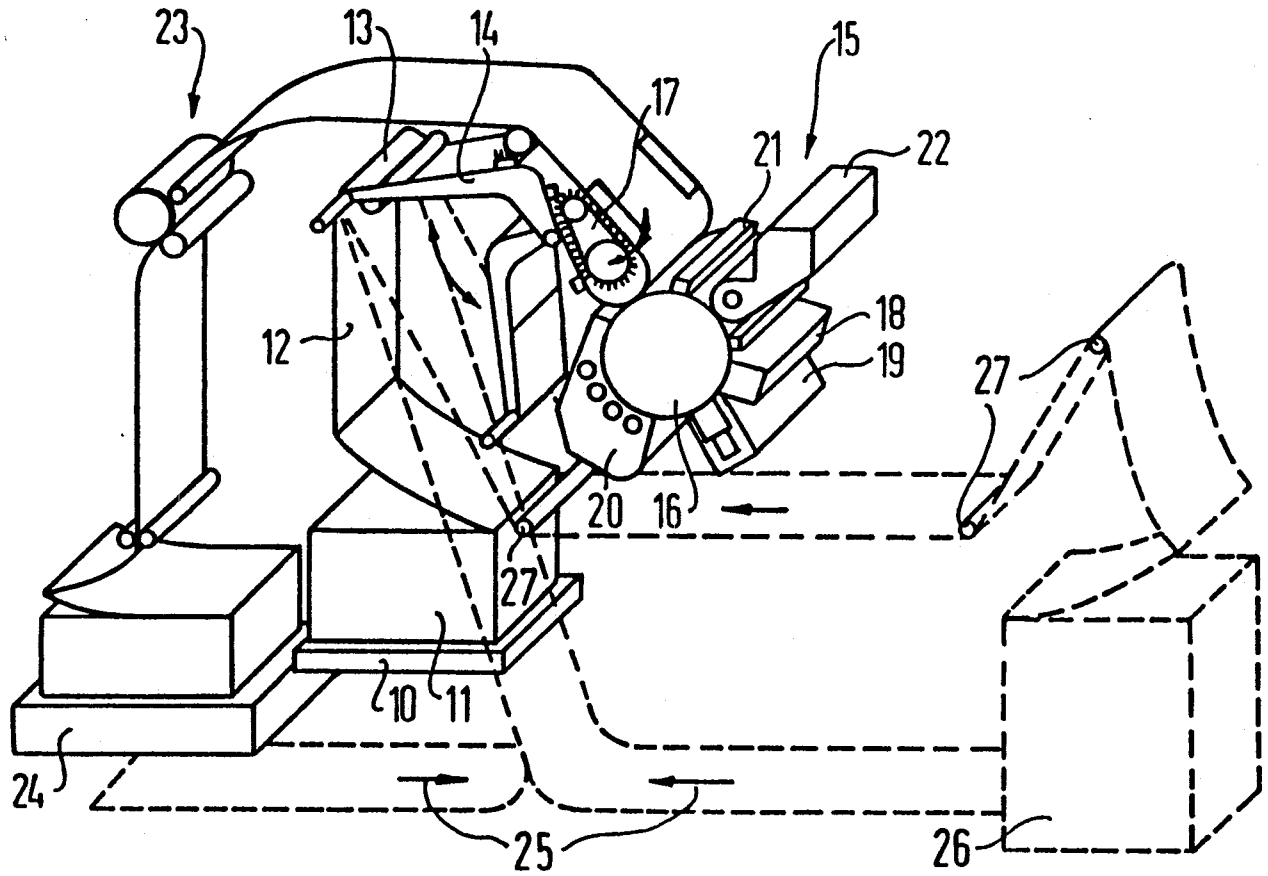
FIG. 1 shows, in a basic representation, the design structure of an electrophotographic printer, in which various physical units are to be oriented exactly with respect to a transport path of a web-shaped recording carrier.

The electrophotographic printer shown diagrammatically in FIG. 1 has a supply table 10 receiving a supply stack 11 of prefolded continuous stock 12. The recording carrier 12 is fed to the actual electrophotographic printing assembly 15 by way of a paper-divider device 13 and an actuating rocker 14 which is equipped with paper-guide elements and can be pivoted away. This printing assembly 15 has a transfer-printing station 17 pivotable to and away from a photoconductive drum 16 as well as further devices arranged around the photoconductive drum and required for the electrophotographic process.

Thus, the photoconductive drum is charged by a charging device 18, to generate a toner image in the recording carrier 11, and is discharged via an LED character generator 19 as a function of the printing information. The generated charge image is inked in a developer station 20 with a developer mixture of toner particles and carrier particles and in the transfer-printing station 17 is transferred onto the recording carrier 12. Thereafter, the photoconductive drum 16 is discharged via a discharge station 21 and cleaned in a cleaning station 22, so that it can be charged again via the charging device 18.

The recording carrier 12 now carrying the toner image is fed from the transfer-printing station 17 to a fixing station for the smudge-proof fixing of the toner image and is subsequently deposited on a delivery table 24. If the printer is coupled, for example, to further printing devices, for example in order to allow recto or verso printing, the web-shaped recording carrier 12 can also be fed directly to the paper-divider device 13 by way of external paper-feed channels 25. It is conceivable, furthermore, to use as a supply stack a supply stack 26 not integrated in the printer, and for this further paper-feed elements 27 may be necessary.

Even the diagrammatic representation illustrates the relatively complex construction of an electrophotographic printer, in which the printing result is determined by, among other things, also how exact the run of the recording carrier 12 through the individual stations is. Essential for this are accurate paper guides, especially deflections, and particularly also the mutually parallel arrangement of the physical units through which the recording carrier is to run.

FIG. 1 illustrates, even in diagrammatic form, that it is expedient to design at least the photoconductive drum 16 and the assemblies 17 to 22 arranged around it as a common physical unit. Furthermore, all the essential elements for guiding the recording carrier 12, at least those in the region of the electrophotographic printing assembly 15, are likewise to be regarded as a physical unit. It is assumed, in this exemplary embodiment, that the elements for paper transport, for example 13, 14 and 27, form together with the electrophotographic printing assembly 15 a mechanically rigidly coupled unit which is designated hereafter as a basic unit. As shown in FIG. 1, the fixing station 23 and especially also the paper-stacking devices, particularly the delivery table 24, are separated spatially from this. There is therefore the problem of orienting these spatially separated physical units, such as the delivery table 24, with its stacking devices, and the fixing station 23, axially parallel with the basic unit 28.

Figure 2:
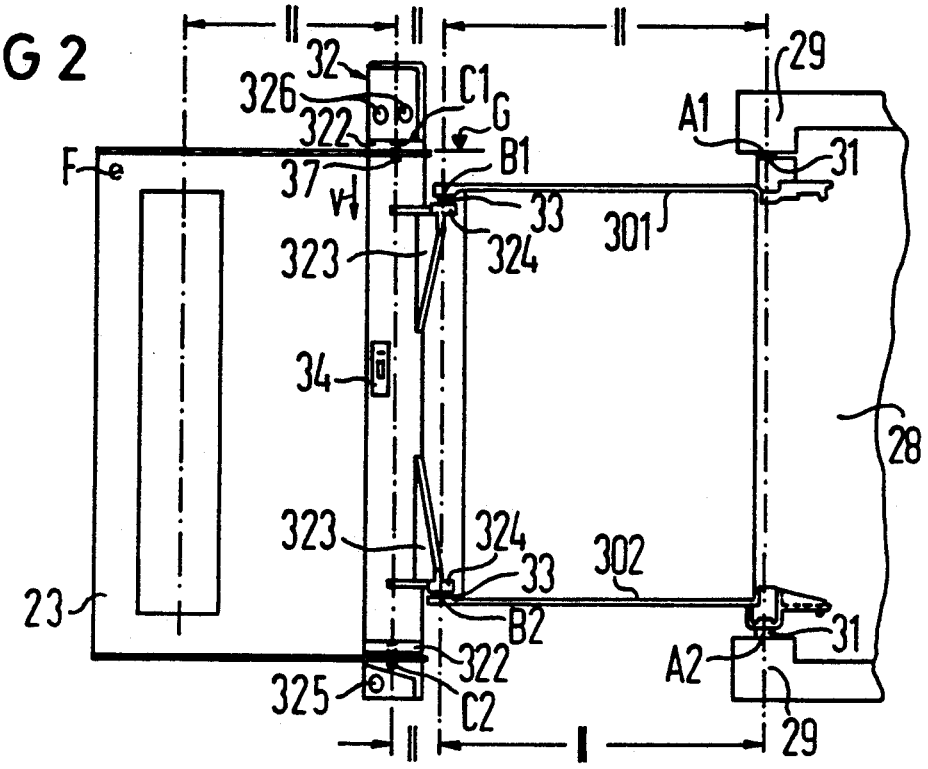
FIG. 2 and FIG. 3 show respectively in a top view and a side view the constructive arrangement according to the invention for the mechanical coupling of such physical units, which allows an axially parallel orientation of these physical units through which the recording carrier runs.
Figure 3:
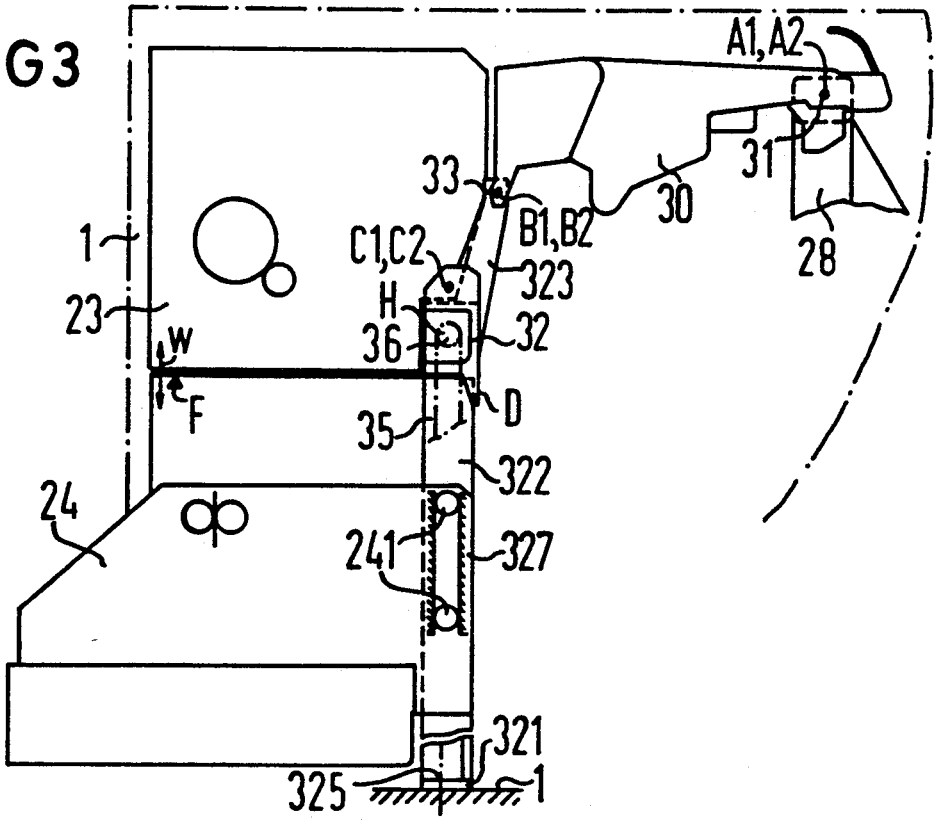

FIGS. 2 and 3 now show in detail respectively in a top view and a side view the means by which this axially parallel orientation is obtained, without this parallelism first having to be set by means of complicated adjustment measures during assembly. In order to elucidate the solution according to the invention, all the details not absolutely necessary are omitted in the representation of FIGS. 2 and 3, thereby ensuring a corresponding clarity of representation. Thus, only a frame element of the basic unit 28 is indicated diagrammatically in part section, and it is assumed that all the parts of the basic unit 28 have a specific position with respect to this frame element. The basic unit 28 has two bearing lugs 29 which, as required, are oriented axially parallel to one another. A crossmember 30 is suspended in these bearing lugs 29 via connecting pins 31. This crossmember 30 consists of two crossmember elements 301 and 302 which are designed, for example, as two cast-iron rails and which are not connected rigidly to one another.

A further coupling element is a carrier 32, the basic form of which is made U-shaped, that is to say two sides parts 322 stand on a base part 321 at a distance from one another and confronting one another. The side parts 322 of the carrier 32 have laterally upwardly projecting arms 323 coupled rigidly to them and each having a further bearing lug 324, in which one of the ends, remote from the basic unit 28, of the crossmember elements 301 or 302 is suspended via further connecting pins 33.

The carrier 32 is connected to a frame 1, shown only diagrammatically, of the printer, by means of its base part 321 via three seating points 325 and 326. The carrier 32 is oriented exactly vertically with the printer frame 1 via these three seating points 325 and 326. This is indicated diagrammatically by a level 34. Orientation is obtained by placing appropriate shims at the seating points 325 and 326, in order to set the exact verticality of the carrier 32. As soon as the carrier 32 is exactly oriented vertically, because of the connecting crossmember 30 it is also simultaneously axially parallel with the basic unit 28, as indicated in FIG. 2 by a parallelism symbol in the connecting line of the suspension points A1, B1, and A2, B2 of the crossmember elements 301 and 302.

The physical units to be coupled axially parallel to the basic unit 28, that is to say in this exemplary embodiment the delivery table 24, with its stacking devices, and the fixing station 23, are now fastened to this carrier 32. The delivery table 24 shown in FIG. 1 in actual fact contains an entire destacking device. It is easily conceivable that this stack table 24 has to execute, during operation, a vertical raising and lowering movement which is dependent on the forming stack height of the deposited recording carrier 11. The vertical guide for the stack table 24 is arranged in the side parts 322 of the carrier 32. FIG. 3 indicates diagrammatically a running profile 327, in which the work table 24 is guided via running rollers 241. Also indicated diagrammatically is a running chain 35 which runs off via a drive pinion 36. Let the running chain 35 be fastened on one side in a side part 322 of the carrier 32 and be connected at its other end to the stack table 34. The stack table 24 is then raised upwards or lowered downwards depending on the direction of rotation of the drive pinion 36 driven via a motor.

In order to achieve this function, again in axially parallel orientation with the basic unit 28, the running profiles 327 are pushed into a receptacle, indicated diagrammatically in FIG. 3, of the side parts 322 of the carrier 32, as represented at the point D of FIG. 3. Moreover, as represented at point H of FIG. 3, these side parts receive the above-described drive unit for the upper part of the work table. The work table 24, suspended in the side parts 322 of the carrier 32, together with its integrated running rollers 241, is thus oriented axially parallel with the other physical units of the printer.

The fixing station 23 is suspended in the side parts 322 of the carrier 32 at the points C1 and C2 via two further connecting pins 37. FIG. 2 illustrates that it is brought to bear at a point G with respect to one of the side parts 322 of the carrier 32. FIG. 3 in particular illustrates that the fixing station 23 is supported at a point F fixed relative to the housing and functioning as a seating point. This seating point F and the bearing point G form the two fixed points for the arrangement of the fixing station 23 arranged rotatably at the suspension points C1, C2. It is thus coupled axially parallel to the remaining physical units of the printer, in such a way that the appropriate degrees of freedom remain for heat-induced expansions in length of the fixing station 23 in the indicated directions v and w, that is to say in the axial direction and perpendicularly to this. This coupling of the fixing station 23 is important particularly also because it affords not only the possibility of length expansion, but also the precondition that the fixing station 23 be exchangeable as an independent physical unit at any time, without special adjustment operations, simply by being suspended in the carrier 32.

The above-described exemplary embodiment explains the principle of this construction concept and can be extended beyond the chosen example. Thus, it would be possible, for example, also to couple mechanically to the remaining construction units of the printer, in a similar way, parts of the assemblies of the electrophotographic printer which are allocated to the basic unit here, such as, for example, the feed compartment. The invention is therefore not restricted only to the mechanical coupling of the structural units described.

Although other modifications and changes may be suggested by those skilled in the art, it is the intention of the inventors to embody within the patent warranted hereon all changes and modifications as reasonably and properly come within the scope of their contribution to the art.

We claim:

1. An electrophotographic printer or copier, comprising:

a basic unit including a printing assembly, a machine frame on which said basic unit is mounted so that a major axis of said basic unit is substantially parallel to a transport path of a recording carrier to be printed and substantially perpendicular to a transport direction of the recording carrier;

physical units having major axes substantially parallel to said major axis of said basic unit;

a support structure separate from said machine frame and having paired receptacles in which respective ones of said physical units are mounted, said support structure including:

a base part resting on said machine frame, two upright side parts on respective sides of the transport path arranged in an upright position in a common plane oriented parallel to said major axis of said basic unit and rigidly connected to said base part;

a pair of cross members spaced apart from one another and substantially parallel to one another, said cross members being substantially perpendicular to said major axis of said basic unit and being connected pivotally at distal ends to said basic unit by respective points and to a respective one of said upright side parts; and adjustment means for orienting said support structure substantially vertically relative to said machine frame.

2. An electrophotographic printer or copier as claimed in claim 1, wherein one of said physical units to be coupled to said basic unit comprises a fixing station.

3. The electrophotographic printer or copier as claimed in claim 1, wherein the base part of the support structure has three seating points, at which it is vertically orientable with respect to the machine frame in a state already articulated on the basic unit via the crossmembers.

4. The electrophotographic printer or copier as claimed in claim 1, wherein the upright side parts each have an arm projecting laterally transversely to the major axis and having a bearing lug, on which one end of each of the crossmember elements is respectively articulated rotatably via a connecting element, other ends of the crossmember elements being respectively articulated on one of two bearing lugs of the basic unit via a further connecting element.

5. The electrophotographic printer or copier as claimed in claim 1, wherein the physical unit to be coupled is suspended pivotably at two receiving points arranged mirror-symmetrically to one another in the upright side parts, and on one of the machine frame and the support structure there is provided a seating point at which said physical unit is supported vertically.

6. The electrophotographic printer or copier as claimed in claim 5, further comprising: a bearing face provided on the support structure, for the physical unit to be coupled, as a reference line for the orientation of the physical unit parallel to the major-axes direction.

7. The electrophotographic printer or copier as claimed in claim 1, wherein the upright side parts of the support structure each have a running profile, and a physical unit to be coupled possesses laterally arranged running rollers which are inserted into the running profiles, at least one of the running rollers being at a predetermined vertical distance from the others, and vertical supporting means being provided for the physical unit to be coupled.

8. The electrophotographic printer or copier as claimed in claim 7, wherein the physical unit to be coupled is arranged vertically displaceably in the side parts of the support structure, the supporting means being designed as raising and lowering means for allowing a vertical movement of the running rollers in the running profiles.

9. The electrophotographic printer or copier as claimed in claim 8, wherein the raising and lowering means include a motor-driven pinion, mounted rotationally movably in the upright side parts above the displaceably arranged physical unit, and a chain being in engagement with the pinion.

10. The electrophotographic printer or copier as claimed in claim 9, further comprising: second receptacles provided in the side parts of the support structure.

11. The electrophotographic printer or copier as claimed in claim 10, wherein the second receptacles are for the pinion coupled to a drive unit.

12. The electrophotographic printer or copier as claimed in claim 10, wherein the receptacles are for the chain.

13. The electrophotographic printer or copier as claimed in claim 10, wherein the second receptacles are for running rails which form the running profiles.

14. The electrophotographic printer or copier as claimed in claim 9, wherein ends of the chain are fastened fixedly in place.

15. The electrophotographic printer or copier as claimed in claim 9, wherein ends of the chain are articulated on the physical unit.

16. The electrophotographic printer or copier as claimed in claim 1, further comprising: a paper-stacking device as one of the physical units to be coupled to the basic unit.

* * * * *